US009796552B2

(12) United States Patent
Fukumoto et al.

(10) Patent No.: US 9,796,552 B2
(45) Date of Patent: Oct. 24, 2017

(54) PAPER FEEDING APPARATUS, IMAGE FORMING APPARATUS, IMAGE FORMING SYSTEM

(71) Applicants: Takashi Fukumoto, Kanagawa (JP); Yasuo Niikura, Kanagawa (JP); Hidetoshi Kojima, Kanagawa (JP); Hideaki Takahashi, Kanagawa (JP); Munehisa Fuda, Kanagawa (JP); Hisayoshi Sugawara, Kanagawa (JP); Kiyotake Nakamura, Kanagawa (JP); Kazunori Konno, Kanagawa (JP); Tatsuya Sugawara, Kanagawa (JP); Toshihiro Okutsu, Kanagawa (JP); Kohjiroh Haga, Kanagawa (JP)

(72) Inventors: Takashi Fukumoto, Kanagawa (JP); Yasuo Niikura, Kanagawa (JP); Hidetoshi Kojima, Kanagawa (JP); Hideaki Takahashi, Kanagawa (JP); Munehisa Fuda, Kanagawa (JP); Hisayoshi Sugawara, Kanagawa (JP); Kiyotake Nakamura, Kanagawa (JP); Kazunori Konno, Kanagawa (JP); Tatsuya Sugawara, Kanagawa (JP); Toshihiro Okutsu, Kanagawa (JP); Kohjiroh Haga, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/364,765

(22) Filed: Nov. 30, 2016

(65) Prior Publication Data

US 2017/0081140 A1 Mar. 23, 2017

Related U.S. Application Data

(63) Continuation of application No. 14/926,606, filed on Oct. 29, 2015, now Pat. No. 9,540,193.

(30) Foreign Application Priority Data

Nov. 4, 2014 (JP) ..... 2014-224450

(51) Int. Cl.
*B65H 1/08* (2006.01)
*B65H 9/10* (2006.01)
(Continued)

(52) U.S. Cl.
CPC ..... *B65H 9/101* (2013.01); *B65H 1/04* (2013.01); *B65H 1/08* (2013.01); *B65H 1/12* (2013.01);
(Continued)

(58) Field of Classification Search
CPC ... B65H 1/08; B65H 1/12; B65H 1/22; B65H 3/128; B65H 3/46; B65H 3/48; B65H 3/54; B65H 3/56; B65H 3/565; B65H 3/60
(Continued)

(56) References Cited

U.S. PATENT DOCUMENTS 8,702,093 B2 4/2014 Hirahara
9,540,193 B2 * 1/2017 Fukumoto ..... B65H 1/12
(Continued)

FOREIGN PATENT DOCUMENTS

JP 2011-068455 A 4/2011

*Primary Examiner* — David H Bollinger
(74) *Attorney, Agent, or Firm* — Harness, Dickey & Pierce, P.L.C.

(57) ABSTRACT

A paper feeding apparatus includes: a sheet loading unit for loading a bundle of sheets; a separation unit that separates a topmost sheet of the bundle of sheets loaded on the sheet loading unit, from the bundle of sheets; a conveyance unit that conveys the separated topmost sheet; an end fence that is movable in a sheet conveyance direction, abuts trailing ends in the sheet conveyance direction, and positions the
(Continued)

bundle of sheets in the sheet conveyance direction; and a pressing unit that is provided in such a manner as to protrude from the end fence, and is able to press the trailing ends in the sheet conveyance direction of at least an upper part of the bundle of sheets, wherein the pressing unit has different pressing forces at an upper and a lower portion thereof, and has the lower pressing force stronger than the upper pressing force.

16 Claims, 14 Drawing Sheets

(51) Int. Cl.

| | |
|---|---|
| ***B65H 5/06*** | (2006.01) |
| ***B65H 3/12*** | (2006.01) |
| ***B65H 3/56*** | (2006.01) |
| ***B65H 1/22*** | (2006.01) |
| ***B65H 3/48*** | (2006.01) |
| ***B65H 3/54*** | (2006.01) |
| ***B65H 3/60*** | (2006.01) |
| ***B65H 3/46*** | (2006.01) |
| ***B65H 1/12*** | (2006.01) |
| ***B65H 1/14*** | (2006.01) |
| ***B65H 1/04*** | (2006.01) |
| ***B65H 1/18*** | (2006.01) |
| ***B65H 7/02*** | (2006.01) |
| ***G03G 15/00*** | (2006.01) |

(52) U.S. Cl.
CPC ..... *B65H 1/14* (2013.01); *B65H 1/18* (2013.01); *B65H 1/22* (2013.01); *B65H 3/128* (2013.01); *B65H 3/46* (2013.01); *B65H 3/48* (2013.01); *B65H 3/54* (2013.01); *B65H 3/56* (2013.01); *B65H 3/565* (2013.01); *B65H 3/60* (2013.01); *B65H 5/062* (2013.01); *B65H 5/068* (2013.01); *B65H 7/02* (2013.01); *G03G 15/6529* (2013.01); *B65H 2402/23* (2013.01); *B65H 2405/1122* (2013.01); *B65H 2511/11* (2013.01); *B65H 2511/20* (2013.01); *B65H 2801/06* (2013.01)

(58) Field of Classification Search
USPC ..... 271/97, 98, 145, 147, 160, 171
See application file for complete search history.

(56) References Cited

U.S. PATENT DOCUMENTS

| | | | |
|---|---|---|---|
| 2004/0135306 | A1 | 7/2004 | Takahashi |
| 2008/0297580 | A1 | 12/2008 | Fukumoto et al. |
| 2009/0014948 | A1 | 1/2009 | Takahashi |
| 2010/0007079 | A1 | 1/2010 | Balahan et al. |
| 2010/0148430 | A1 | 6/2010 | Fuda |
| 2011/0148027 | A1 | 6/2011 | Fuda |
| 2011/0187042 | A1 | 8/2011 | Fuda |
| 2011/0187044 | A1 | 8/2011 | Utagawa et al. |
| 2011/0193284 | A1 | 8/2011 | Fuda |
| 2011/0221119 | A1 | 9/2011 | Fuda |
| 2011/0278787 | A1 | 11/2011 | Fukusaka et al. |
| 2012/0061910 | A1 | 3/2012 | Ford et al. |
| 2012/0133092 | A1 | 5/2012 | Fuda et al. |
| 2012/0313315 | A1 | 12/2012 | Fukumoto et al. |
| 2013/0062827 | A1 | 3/2013 | Fuda |
| 2013/0087967 | A1 | 4/2013 | Fuda et al. |
| 2013/0106045 | A1 | 5/2013 | Okutsu et al. |
| 2013/0106047 | A1 | 5/2013 | Tsuji et al. |
| 2013/0334764 | A1 | 12/2013 | Fuda |
| 2014/0339759 | A1 | 11/2014 | Takahashi et al. |
| 2014/0339761 | A1 | 11/2014 | Oikawa et al. |
| 2014/0346728 | A1 | 11/2014 | Fuda et al. |
| 2015/0166280 | A1 | 6/2015 | Hino et al. |
| 2015/0225191 | A1 | 8/2015 | Niikura et al. |
| 2015/0239692 | A1 | 8/2015 | Furuichi et al. |

* cited by examiner

PAPER FEEDING APPARATUS, IMAGE FORMING APPARATUS, IMAGE FORMING SYSTEM

CROSS-REFERENCE TO RELATED APPLICATIONS

This application is a continuation application of and claims priority under 35 U.S.C. §120/121 to U.S. application Ser. No. 14/926,606 filed Oct. 29, 2015, which claims priority under 35 U.S.C. §119 to Japanese Patent Application No. 2014-224450 filed in Japan on Nov. 4, 2014, the entire contents of each of which are hereby incorporated herein by reference.

BACKGROUND OF THE INVENTION

1. Field of the Invention

The present invention relates to a paper feeding apparatus, an image forming apparatus, and an image forming system.

2. Description of the Related Art

An air separation system is proposed as a method for separating and conveying loaded paper sheets in a paper feeding apparatus used in an image forming apparatus. As an example of the air separation system, air is blown by a blower being an air issuing unit to leading ends of an upper part of a loaded bundle of sheets. An air layer is formed between at least leading ends in a sheet conveyance direction (hereinafter simply referred to as leading ends) of the topmost and second sheets to cause at least the leading end of the topmost sheet to rise. The rising topmost sheet is suctioned by a suction unit, adsorbed to an adsorption belt, and separated.

Japanese Patent Application Laid-open No. 2011-68455 describes a paper feeding apparatus provided, at an upper portion of an end fence for abutting and positioning trailing ends in the sheet conveyance direction (hereinafter simply referred to as trailing ends) of a bundle of sheets mounted on a sheet mount board, with a pressing member being a pressing unit protruding from the end fence toward the bundle of sheets. In the paper feeding apparatus, the trailing ends of the upper part of the bundle of sheets are pressed by a pressing force of the pressing member protruding from the end fence to cause the leading ends of the upper sheets to abut a front fence. Accordingly, the trailing ends of the sheets are positioned by the pressing member. Consequently, even if there is a gap between the end fence and the trailing ends of the bundle of sheets, at least the trailing ends of the upper part of the bundle of sheets are positioned by the pressing member. Consequently, when the leading end of the topmost sheet of the bundle of sheets rises due to the air blown from a blower, it is possible to stop the backward movement of the topmost sheet. As a result, it is possible to prevent the leading end of the second sheet from being located downward in the sheet conveyance direction from the leading end of the topmost sheet, and the leading end of the second sheet from being adsorbed to the adsorption belt, together with the topmost sheet. As a result, it is described that it is possible to prevent the occurrence of double feed due to such an adsorption.

However, in Japanese Patent Application Laid-open No. 2011-68455, there may be a case where a sheet cannot rise smoothly so that the sheet cannot be adsorbed to the adsorption belt by a sheet conveyance timing to lead to the occurrence of paper feeding failure.

SUMMARY OF THE INVENTION

It is an object of the present invention to at least partially solve the problems in the conventional technology.

According to example embodiments of the present invention, there is provided a paper feeding apparatus comprising: a sheet loading unit on which a bundle of sheets is loaded; a separation unit that separates a topmost sheet of the bundle of sheets loaded on the sheet loading unit, from the bundle of sheets; a conveyance unit that conveys the separated topmost sheet; an end fence that is movable in a sheet conveyance direction, abuts trailing ends in the sheet conveyance direction of the bundle of sheets, and positions the bundle of sheets in the sheet conveyance direction; and a pressing unit that is provided in such a manner as to protrude from the end fence, and is configured to be able to press the trailing ends in the sheet conveyance direction of at least an upper part of the bundle of sheets, wherein the pressing unit is configured to have different pressing forces at an upper and a lower portion thereof, and have the lower pressing force stronger than the upper pressing force.

Example embodiments of the present invention also provide an image forming apparatus comprising: an image forming unit that forms an image on a sheet; and a paper feeding unit that feeds sheets to the image forming unit, the paper feeding unit including; a sheet loading unit on which a bundle of sheets is loaded, a separation unit that separates a topmost sheet of the bundle of sheets loaded on the sheet loading unit, from the bundle of sheets, a conveyance unit that conveys the separated topmost sheet, an end fence that is movable in a sheet conveyance direction, abuts trailing ends in the sheet conveyance direction of the bundle of sheets, and positions the bundle of sheets in the sheet conveyance direction, and a pressing unit that is provided in such a manner as to protrude from the end fence, and is configured to be able to press the trailing ends in the sheet conveyance direction of at least an upper part of the bundle of sheets, wherein, the pressing unit is configured to have different pressing forces at an upper and a lower portion thereof, and have the lower pressing force stronger than the upper pressing force.

Example embodiments of the present invention also provide an image forming system comprising: an image forming apparatus including at least an image forming unit configured to form an image on a sheet; and a paper feeding apparatus configured to feed sheets to the image forming apparatus, the paper feeding apparatus including; a sheet loading unit on which a bundle of sheets is loaded, a separation unit that separates a topmost sheet of the bundle of sheets loaded on the sheet loading unit, from the bundle of sheets, a conveyance unit that conveys the separated topmost sheet, an end fence that is movable in a sheet conveyance direction, abuts trailing ends in the sheet conveyance direction of the bundle of sheets, and positions the bundle of sheets in the sheet conveyance direction, and a pressing unit that is provided in such a manner as to protrude from the end fence, and is configured to be able to press the trailing ends in the sheet conveyance direction of at least an upper part of the bundle of sheets, wherein, the pressing unit is configured to have different pressing forces at an upper and a lower portion thereof, and have the lower pressing force stronger than the upper pressing force.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
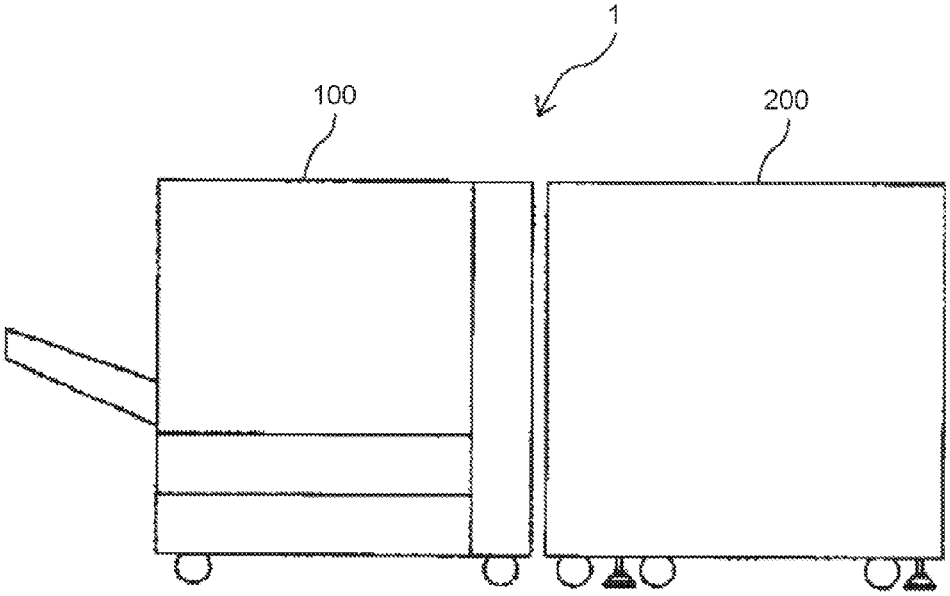
FIG. 1 is a schematic configuration diagram of an image forming system of an embodiment of the present invention.

The present invention is described hereinafter based on the accompanying drawings. The same reference numerals are assigned to components such as members and constituent parts that have the same function or shape as long as they are distinguishable in the drawings for explaining the present invention. Accordingly, their descriptions are omitted after they are described once.

FIG. 1 is a schematic configuration diagram of an image forming system 1 of the embodiment.

As illustrated in FIG. 1, the image forming system 1 includes an image forming apparatus 100, and a paper feeding apparatus 200 that feeds sheets to the image forming apparatus. The paper feeding apparatus 200 is provided to a side surface of a main body of the image forming apparatus 100.

Firstly, a description is given of the entire configuration and operation of the image forming apparatus such as a printer and a copier having an equivalent image formation function, to which the paper feeding apparatus of the embodiment can be applied.

Figure 2:
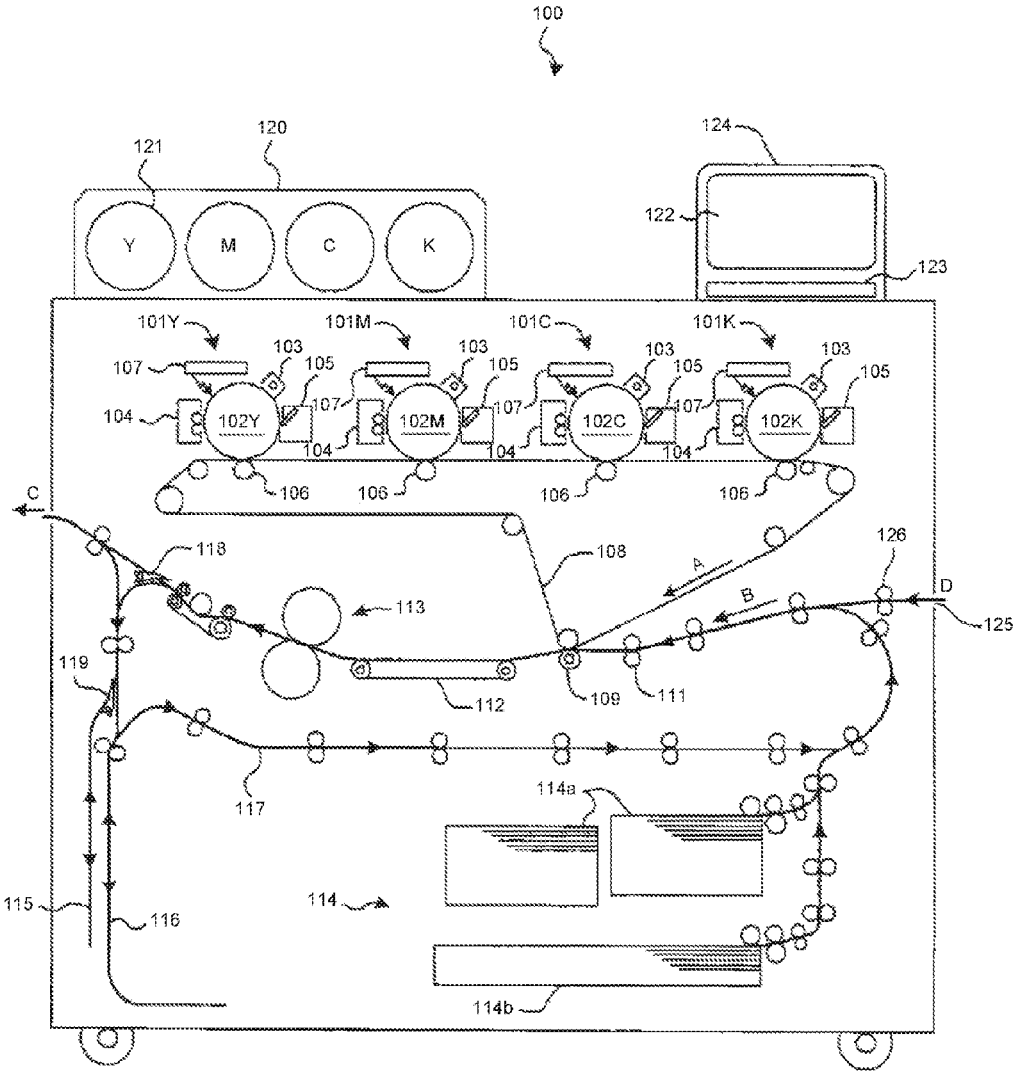
FIG. 2 is a schematic configuration diagram of an image forming apparatus according to the embodiment.

FIG. 2 is a schematic configuration diagram of the image forming apparatus 100 according to the embodiment.

The image forming apparatus 100 is a full-color printer using toners of four colors, yellow (Y), cyan (C), magenta (M), and black (K), and a full-color copier having an equivalent image formation function. As illustrated in FIG. 1, four image formation units 101Y, 101M, 101C, and 101K that form an image in each color toner are arranged side by side in an upper part in the apparatus body. The configuration and operation of each of the image formation units 101Y, 101M, 101C, and 101K are substantially the same. Therefore, the image formation unit is described here, omitting codes (Y, M, C, and K) indicating the colors. In the image formation unit 101, a charger 103, a developing device 104, a cleaning device 105, and the like are arranged around a photoconductor drum 102 as an image bearer. Moreover, an exposure unit 107 is arranged above the photoconductor drum 102.

An intermediate transfer belt 108 looping over a plurality of support rollers is arranged below the four image formation units 101Y, 101M, 101C, and 101K. One of the support rollers is driven and rotated by a non-illustrated drive unit to drive the intermediate transfer belt 108 to run in an arrow A direction. A transfer roller 106 as a primary transfer unit is arranged across the intermediate transfer belt 108 and opposed to the photoconductor drum 102 of each image formation unit.

In each image formation unit 101, the photoconductor drum 102 is driven and rotated in a counterclockwise direction in the figure. The surface of the photoconductor is uniformly charged by the charger 103 to a predetermined polarity. Next, the charged surface is irradiated with a light-modulated laser beam emitted from the exposure unit 107. Consequently, an electrostatic latent image is formed on the photoconductor drum 102. The electrostatic latent image is developed with toner added from the developing device 104, and is made visible as a toner image. Yellow, cyan, magenta, and black toner images formed on the image formation units are sequentially transferred onto the intermediate transfer belt 108 and superimposed there.

On the other hand, a paper feeding unit 114 including paper feeding trays 114*a* and 114*b* is provided in a lower part of the apparatus body. For example, transfer paper is fed as a recording medium from the paper feeding unit 114 or the paper feeding apparatus 200 attached to the image forming apparatus 100 and described below. The fed transfer paper is conveyed toward a registration roller 111 as indicated by an arrow B.

The transfer paper brought into abutment with the registration roller 111 and temporarily stopped is sent out by the registration roller 111 timed to the toner images on the intermediate transfer belt 108. The transfer paper is then transmitted to a secondary transfer unit where a secondary transfer roller 109 is in contact with the intermediate transfer belt 108. A voltage of an opposite polarity to the charging polarity of the toner is applied to the secondary transfer roller 109. Accordingly, the overlapped toner images (a full-color image) on the intermediate transfer belt 108 are transferred onto the transfer paper. The transfer paper after toner image transfer is conveyed by a conveyance belt 112 to a fixing device 113. The toner is fixed by the fixing device 113 on the transfer paper with heat and pressure. The transfer paper after toner image fixing is discharged to the outside of the machine as indicated by an arrow C to be ejected onto an unillustrated paper ejection tray.

In a case of face-down ejection in simplex printing, a sheet is discharged to the outside of the machine through a sheet reversing unit 115 as indicated by the arrow C. Accordingly, the sheet is turned upside down. Moreover, in a case of duplex printing, the fixed sheet passes a duplex reversing unit 116, and is fed again to the registration roller 111 through a refeeding path 117. Accordingly, the toner images are transferred onto the back side of the sheet from the intermediate transfer belt 108. The sheet after toner image transfer is fixed by the fixing device 113, and discharged to the outside of the machine from the fixing device 113 as indicated by the arrow C, or via the sheet reversing unit 115 as indicated by the arrow C as in simplex printing. The sheet is then ejected onto the non-illustrated paper ejection tray. Switching claws 118 and 119 for switching the sheet conveyance direction are arranged as appropriate.

In a case of monochromatic printing, in the image forming apparatus 100 of the example, only the image formation unit 101K of black (K) is used to form a toner image. The toner image is transferred onto transfer paper via the intermediate transfer belt 108. The handling of the sheet after toner image fixing is similar to the case of full-color printing.

A tonner bottle setting unit 120 where a tonner bottle 121 that accommodates toner to be supplied to the developing device 104 of each image formation unit is set for each color is provided on a top surface of the apparatus body. Moreover, an operating unit 124 including a display unit 122 and an operation panel 123 is also provided on the top surface of the apparatus body. Furthermore, a sheet loading unit D from the paper feeding apparatus (see FIG. 3) described below is provided to a side surface on the right side in the figure of the apparatus body. The sheet loading unit D is provided with an opening 125 to receive a sheet, and a conveyance unit 126 that conveys the sheet.

Figure 3:
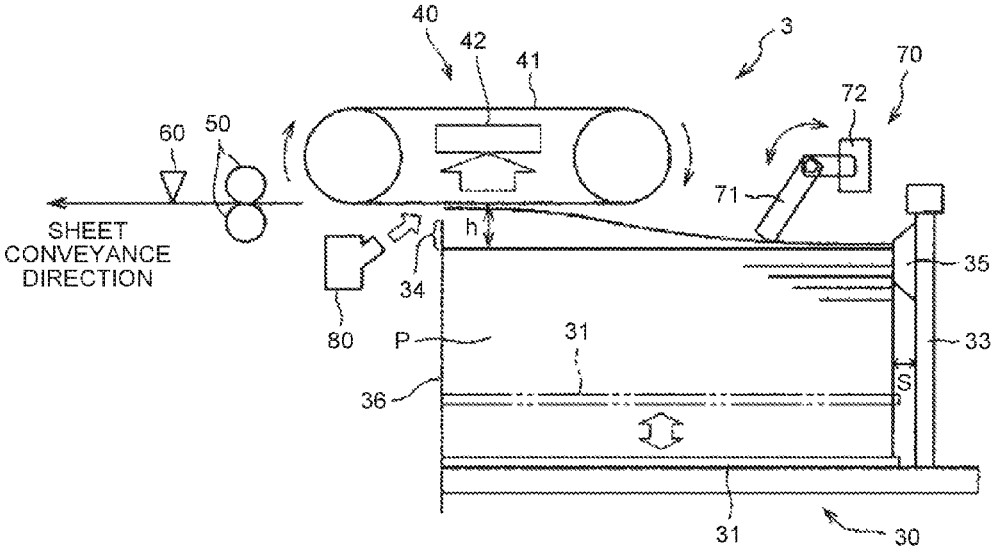
FIG. 3 is a schematic configuration diagram of an entire paper feeding apparatus of the embodiment.
Figure 5:
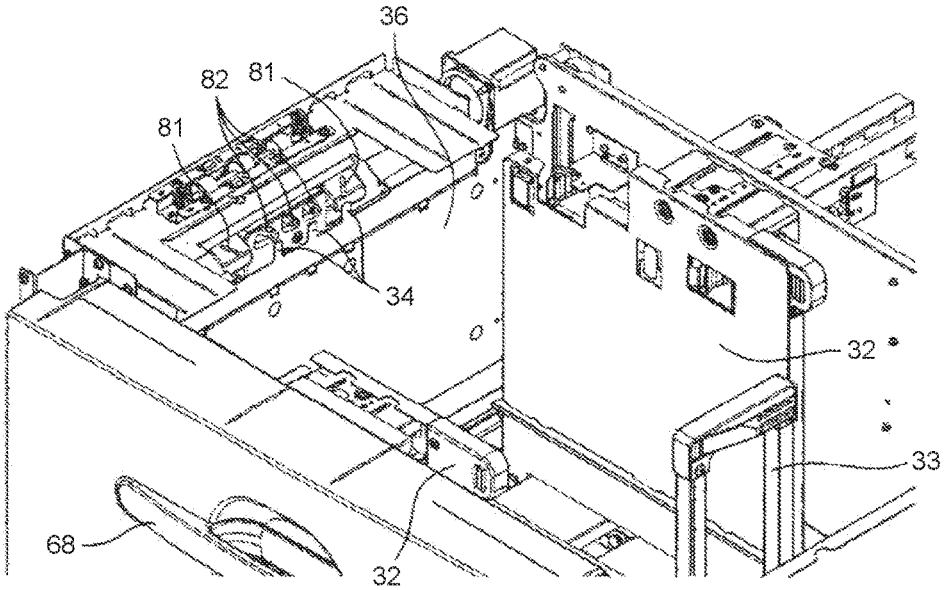
FIG. 5 is a perspective view of the inside of the paper feeding apparatus as viewed from the upstream side of a sheet conveyance direction.
Figure 6:
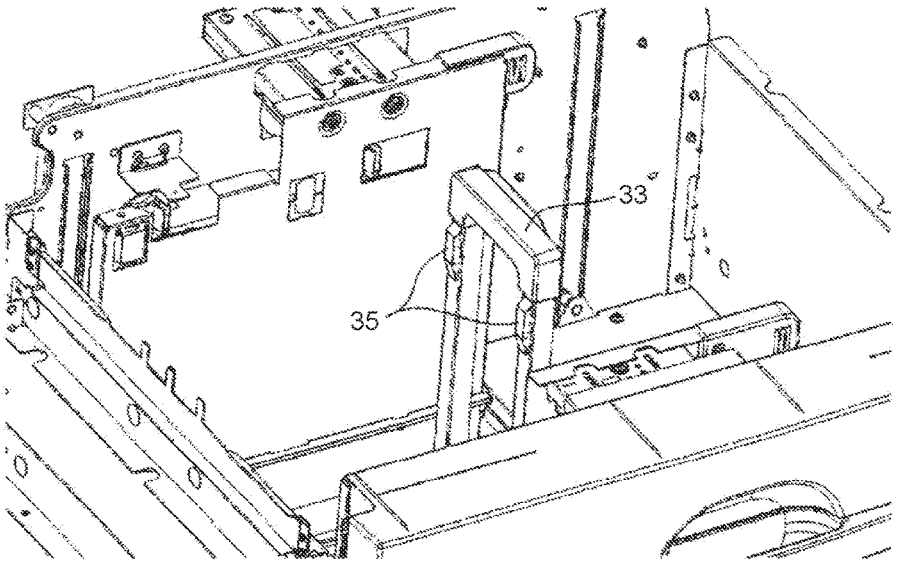
FIG. 6 is a perspective view of the inside of the paper feeding apparatus as viewed from the downstream side of the sheet conveyance direction.

FIG. 3 is a schematic configuration diagram of the entire paper feeding apparatus 200 of the embodiment provided to the side surface of the apparatus body. Moreover, FIGS. 4, 5, and 6 are perspective views illustrating an internal structure of the paper feeding apparatus 200.

As illustrated in FIG. 3, the paper feeding apparatus 200 includes a paper feeding tray 30 where a plurality of sheets P can be loaded, and an adsorption belt unit 40 having, for example, an adsorption belt 41 as an adsorption member that adsorbs and conveys a sheet P. The sheets P include cardboards, postcards, envelopes, plain papers, thin papers, coated papers (such as coat papers and art papers), and tracing papers. Moreover, the paper feeding apparatus according to the embodiment is configured in such a manner as to be able to feed OHP sheets, OHP films, and the like.

Figure 4:
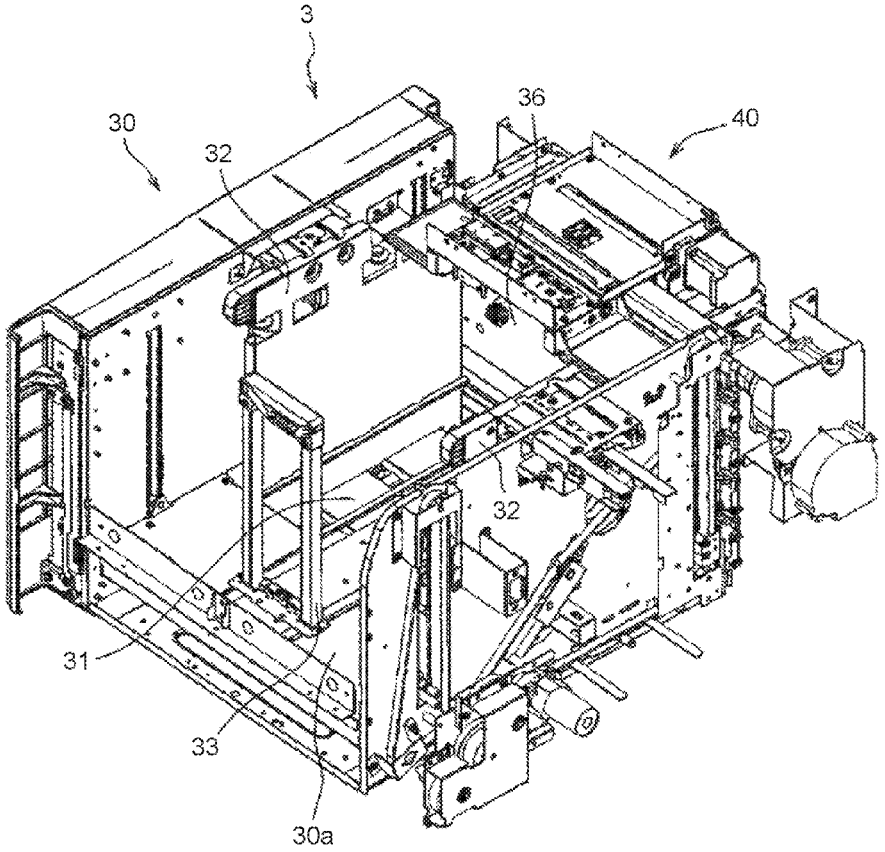
FIG. 4 is a perspective view illustrating an internal structure of the paper feeding apparatus.

As illustrated in FIG. 4, the paper feeding tray 30 includes a bottom plate 31 being a sheet mount board, a front fence 36 that positions leading ends in the conveyance direction of a bundle of sheets loaded on the bottom plate 31, a pair of side fences 32 that positions both ends in the conveyance direction of the bundle of sheets, and an end fence 33 that positions trailing ends in the conveyance direction of the bundle of sheets.

The end fence 33 is attached to a bottom surface 30*a* of the paper feeding tray 30 in such a manner as to be slidable in the sheet conveyance direction. Consequently, the end fence 33 can be slid to a position corresponding to the size of sheets to be loaded, which enables loading of sheets of various sizes.

As illustrated in FIG. 3, the adsorption belt 41 is arranged above the sheets P loaded in the paper feeding tray 30. The adsorption belt 41 is provided with a plurality of suction holes. A suction device 42 is placed inward of the adsorption belt 41. It is so designed that the air suctioned by the suction device 42 through the suction holes adsorbs a sheet to an underside of the adsorption belt 41. Moreover, the adsorption belt 41 is stretched over a plurality of rollers. One of the rollers is driven and rotated to rotate the adsorption belt 41 in an arrow direction in the figure. Moreover, a conveyance roller pair 50 that conveys the sheet P and a sheet detection sensor 60 that detects the conveyed sheet P are sequentially arranged downstream in the sheet conveyance direction from the adsorption belt 41.

A top surface position detection device 70 for detecting the position of the top surface of the bundle of sheets loaded in the paper feeding tray 30 is provided above the paper feeding tray 30. The top surface position detection device 70 includes an actuator 71 that comes into contact with the top surface of the bundle of sheets and is configured in such a manner as to be swingable, and a swing detection sensor 72 that detects the swing of the actuator 71. The actuator 71 is configured to swing as the height of the bundle of sheets is reduced with the supply of sheets from the bundle of sheets. The swing detection sensor 72 detects the swing amount of the actuator 71. Based on a detection signal at this point in time, an unillustrated lifting unit raises the bottom plate 31 of the paper feeding tray 30. Consequently, it is so controlled that a height h (distance) between the topmost surface of the bundle of sheets and the adsorption belt 41 is maintained constant.

A blower 80 as an air issuing unit that blows air to the sheets P loaded in the paper feeding tray 30 is provided forward of the paper feeding tray 30 in the sheet conveyance direction. Moreover, a regulation member 34 that regulates movements of sheets except the topmost sheet (the second and later sheets from the topmost position) in the conveyance direction is provided to an upper end of the front fence 36 of the paper feeding tray 30. The regulation member 34 is disposed in such a manner as to protrude upward of the topmost position of the bundle of sheets loaded in the paper feeding tray 30.

As illustrated in FIG. 5, the blower 80 includes rise-purpose nozzles 81 that issue air for causing sheets to rise, and separation-purpose nozzle 82 that issues air to separate the topmost sheet from the second and later sheets under the topmost sheet. The separation-purpose nozzle 82 is disposed corresponding to a center portion in a sheet-width direction. The rise-purpose nozzles 81 are disposed corresponding to both sides in the sheet-width direction. Moreover, the regulation member 34 is disposed at a position opposed to the separation-purpose nozzle 82.

Moreover, as illustrated in FIG. 3, a pressing member 35 protruding toward the loaded sheets P more than the end fence 33 is provided to an upper portion of the end fence 33. In the embodiment illustrated in FIG. 6, two pressing members 35 are provided. However, the number of pressing members 35 may be one, or three or more.

In the paper feeding apparatus 200 of the embodiment, the paper feeding tray 30 is fixed to a structure of the main body of the paper feeding apparatus 200. The paper feeding tray 30 is configured to be able to be pulled frontward in FIG. 3 with respect to the main body of the paper feeding apparatus 200. A user holds a handle portion 68 illustrated in FIG. 5 to pull it frontward in the figure. Accordingly, the paper feeding tray 30 can be pulled out. The paper feeding tray 30 is pulled out to enable loading and removal of the sheets P from above an area surrounded by the two side fences 32, the front fence 36, and the end fence 33.

Figure 7:
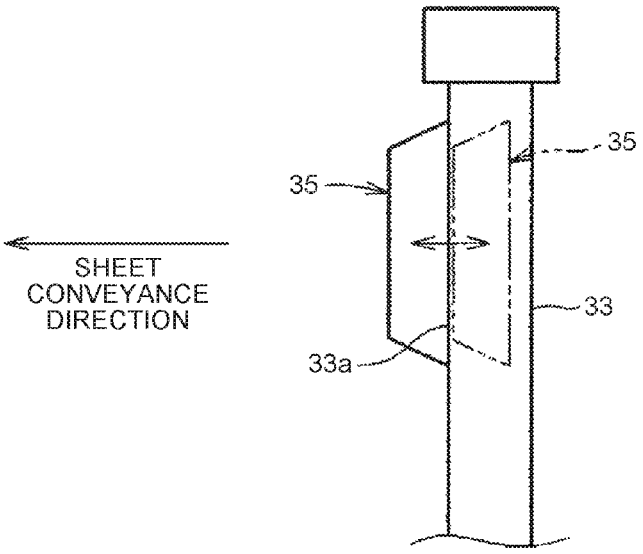
FIG. 7 is a schematic configuration diagram illustrating a pressing member.

FIG. 7 is a schematic configuration diagram illustrating the pressing member 35.

As illustrated in FIG. 7, the pressing member 35 is configured in such a manner as to be able to protrude from and be accommodated in the end fence 33. An elastic member such as an non-illustrated coil spring provided in the end fence 33 biases the pressing member 35 leftward in the figure. Accordingly, the pressing member 35 is normally disposed in a state of protruding from the end fence 33. On the other hand, if a force that presses the pressing member 35 into the end fence is generated, the unillustrated elastic member is depressed to displace the pressing member 35 rightward in the figure. Accordingly, a pressing force is generated. A plate spring, rubber, sponge, and the like, in addition to the coil spring, can also be used as the elastic member. Alternatively, the pressing member 35 itself may constitute the elastic member.

Next, the paper feeding operation of the paper feeding apparatus 200 is described.

Figure 8:
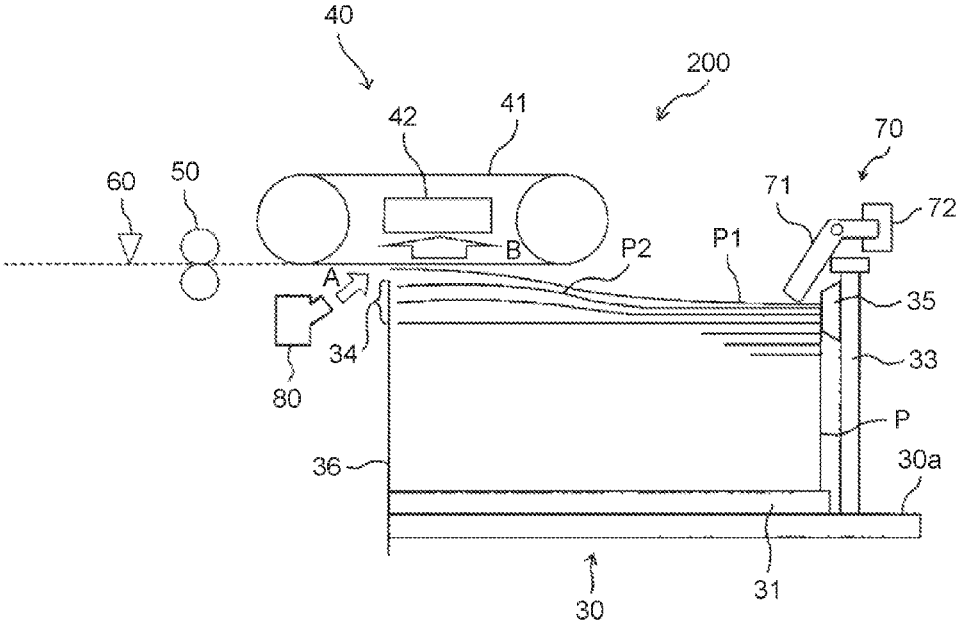
FIG. 8 is an explanatory diagram of a state where air blowing and suction are started in the paper feeding apparatus of the embodiment.

When an instruction to start paper feeding comes from an non-illustrated control unit of the main body of the image forming apparatus 100, the air blowing of the blower 80 being the separation unit and the suction of the suction device 42 are started in a state where the adsorption belt 41 is being stopped as illustrated in FIG. 8. The air blowing of the blower 80 is started to blow air to the front edges of the sheets P as indicated by an arrow A in the figure. A topmost sheet P1 of the loaded sheets P rises. The suction device 42 starts the suction to generate negative pressure below the suction device 42 as indicated by an arrow B in the figure. The rising topmost sheet P1 is adsorbed to the adsorption belt 41.

Figure 9:
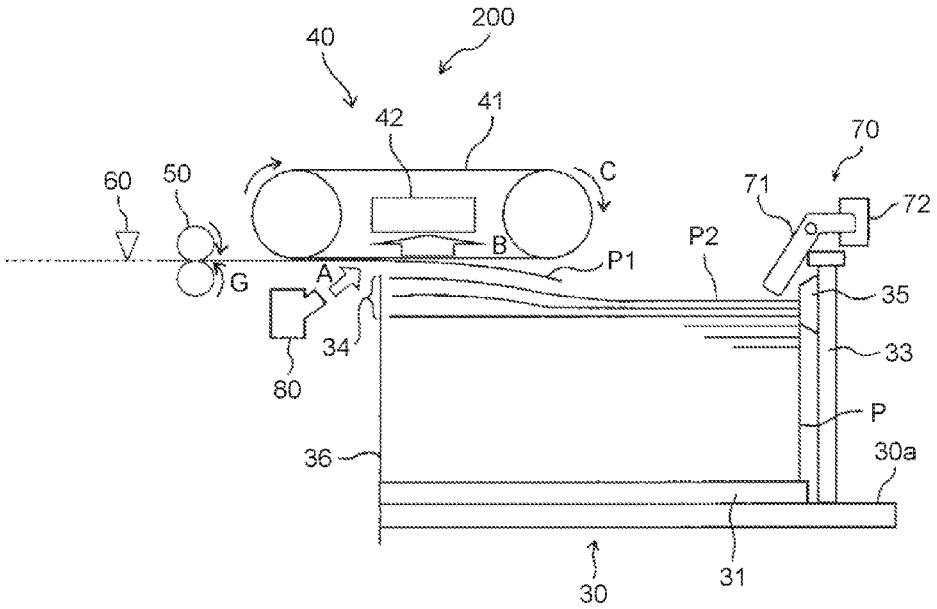
FIG. 9 is an explanatory diagram of a state where the drive of an adsorption belt and a conveyance roller pair is started from the state of FIG. 8.

After a lapse of a predetermined time (for example, three seconds) since the start of the air blowing of the blower 80 and the suction of the suction device 42, the drive of the adsorption belt 41 and the conveyance roller pair 50 starts while the blower 80 and the suction device 42 are in operation, as illustrated in FIG. 9. The drive is transmitted to the adsorption belt 41 to move the surface of the adsorption belt 41 in an arrow C direction (a clockwise direction) in the figure. Accordingly, the topmost sheet P1 adsorbed to the underside of the adsorption belt 41 is conveyed downstream in the conveyance direction. The topmost sheet P1 then reaches the conveyance roller pair 50. The conveyance roller pair 50 is rotated in an arrow G direction in the figure to convey the topmost sheet P1 further downstream.

Figure 10:
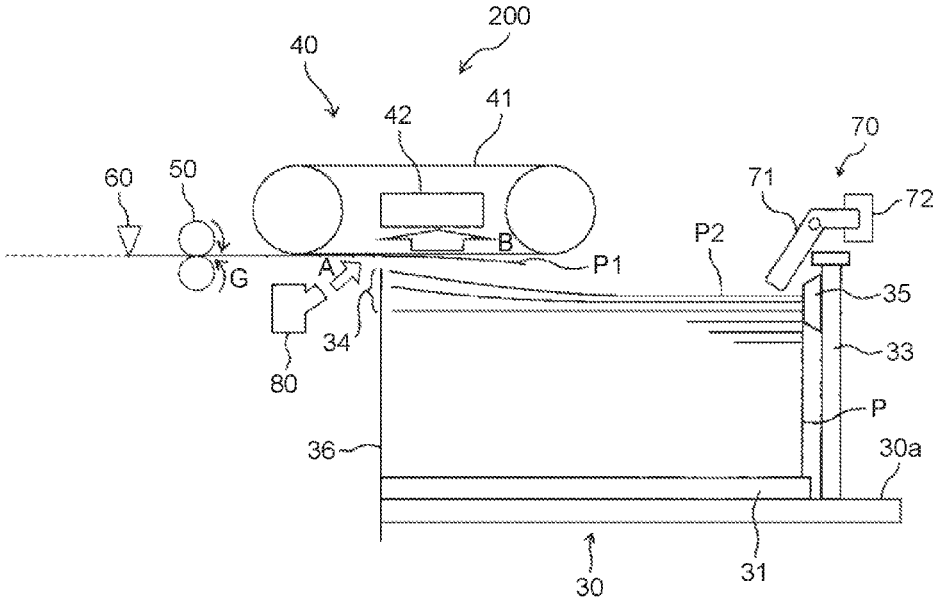
FIG. 10 is an explanatory diagram of a state where the drive of the adsorption belt is stopped from the state of FIG. 9.

As illustrated in FIG. 10, when the sheet detection sensor 60 detects the leading end of the topmost sheet P1 conveyed by the adsorption belt 41 and the conveyance roller pair 50, the drive of the adsorption belt 41 is stopped.

The reason of the control to stop the drive of the adsorption belt 41 in this manner is as follows: that is, if the adsorption belt 41 continues to be driven, the second top sheet P2 being a sheet under the topmost sheet P1 is also adsorbed to the adsorption belt 41 at a stage where the topmost sheet P1 is conveyed and starts coming out of a suction area of the suction device 42. At this point in time, if the adsorption belt 41 is being driven, the second top sheet P2, together with the topmost sheet P1, may also be conveyed to end up in double feed.

Hence, when the sheet detection sensor 60 detects the leading end of the topmost sheet P1, the drive of the adsorption belt 41 is stopped. However, at this point in time, the topmost sheet P1 is in a state of being held by the two rollers of the conveyance roller pair 50. The conveyance roller pair 50 continues to be driven also after the drive of the adsorption belt 41 is stopped. Accordingly, the topmost sheet P1 continues to be conveyed. At this point in time, if the conveyance force of the conveyance roller pair 50 is smaller than the conveyance force of the adsorption belt 41, the topmost sheet P1 stops in a state of sticking to the adsorption belt 41. Therefore, the conveyance of the topmost sheet P1 is stopped. Hence, the conveyance force of the conveyance roller pair 50 is set in such a manner as to be larger than that of the adsorption belt 41.

The conveyance roller pair 50 is driven also after the drive of the adsorption belt 41 is stopped. Accordingly, the conveyance of the topmost sheet P1 is continued.

As illustrated in FIGS. 8 to 10, while the topmost sheet P1 is being adsorbed to the adsorption belt 41, a leading end of the second top sheet P2 is fluttering under the topmost sheet P1 due to the air blown from the blower 80. Consequently, the second top sheet P2 enters a state where its leading end side is separated from the sheets P under the second top sheet P2.

Figure 11:
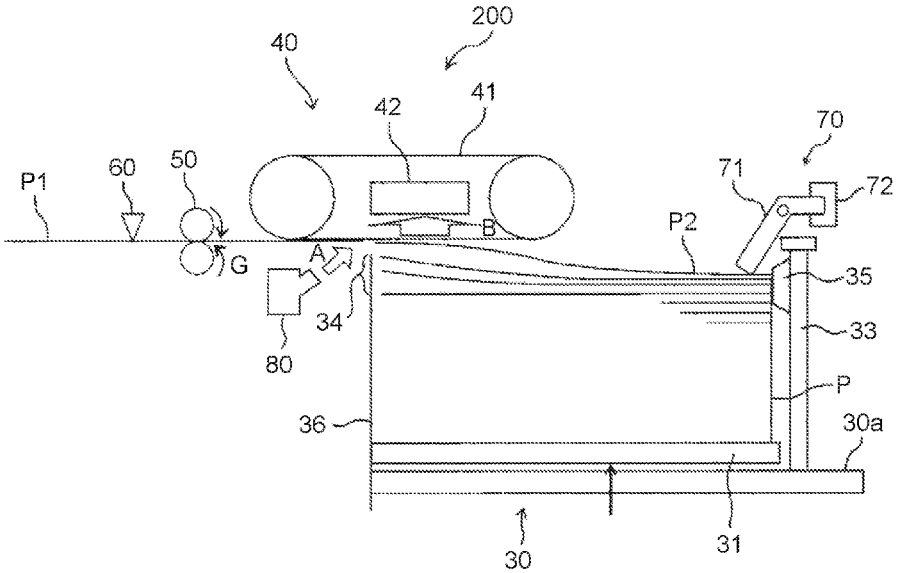
FIG. 11 is an explanatory diagram of a state where a trailing end of a sheet has passed a suction area from the state of FIG. 10.

The trailing edge of the topmost sheet P1 then passes the suction area of the suction device 42. The second top sheet P2 rises immediately afterward due to the flow of air formed between the blower 80 and the suction device 42 as illustrated in FIG. 11. The second top sheet P2 is adsorbed to the adsorption belt 41.

The drive of the adsorption belt 41 is resumed after a lapse of a predetermined time since the timing when the sheet detection sensor 60 detects the leading end of the topmost sheet P1 illustrated in FIG. 10, in accordance with a set paper feeding interval. Consequently, as in the topmost sheet P1 illustrated in FIG. 9, the second top sheet P2 is conveyed by the adsorption belt 41 downstream in the conveyance direction. The second top sheet P2 reaches the conveyance roller pair 50 to be conveyed by the conveyance roller pair 50 further downstream.

The turning ON/OFF of the drive of the adsorption belt 41 is subsequently controlled while the blower 80, the suction device 42, and the conveyance roller pair 50 are in operation. Specifically, the control is repeated as follows: the drive of the adsorption belt 41 is turned OFF when the sheet detection sensor 60 detects the leading end of the sheet P, and the drive of the adsorption belt 41 is turned ON after a lapse of the predetermined time since the timing when the sheet detection sensor 60 detects the leading end of the sheet P. Under such control, the sheets P in the paper feeding tray 30 are sequentially fed one by one to the image forming apparatus 100.

The end fence 33 is attached to the paper feeding tray 30 in such a manner as to be slidable in the sheet conveyance direction to support various sheet sizes. When a bundle of sheets is set in the paper feeding tray 30, the end fence 33 is slid to be withdrawn upstream in the sheet conveyance direction. The leading ends of the bundle of sheets are caused to abut the front fence 36 to set the bundle of sheets aligned. The end fence 33 is slid toward the trailing ends of the bundle of sheets to cause the end fence 33 to abut the trailing ends of the bundle of sheets. Consequently, the leading ends of the bundle of sheets abut the front fence 36, and their trailing ends abut the end fence. The sheets in the paper feeding tray 30 are positioned in the sheet conveyance direction.

However, the end fence 33 is slid manually. Therefore, some users stop moving the end fence 33 before causing the end fence 33 to abut the trailing ends of the bundle of sheets. Accordingly, a gap S may be caused between the end fence 33 and the bundle of sheets. Moreover, the end fence 33 is configured to be slid in the sheet conveyance direction. Hence, play will be caused in the sheet conveyance direction. As a result, even if the end fence 33 is moved until abutting the trailing ends of the bundle sheets, the play may cause the gap S between the end fence 33 and the bundle of sheets as illustrated in FIG. 3.

In a case of a configuration where the pressing member 35 is not provided to the top portion of the end fence 33, if there is the gap S between the end fence 33 and the bundle of sheets as illustrated in FIG. 3, the rising topmost sheet P1 may move back a distance equivalent to the gap S. The rising topmost sheet P1 moves back to cause the leading end of the second top sheet P2 to face the adsorption belt 41. The leading end of the second top sheet P2, together with the topmost sheet P1, is adsorbed to the adsorption belt 41. As a result, two sheets may be conveyed to lead to double feed.

However, in the embodiment, the pressing member 35 is provided to the upper portion of the end fence 33. Hence, even if the gap S is caused between the end fence 33 and the bundle of sheets due to the play in terms of the structure, the pressing member 35 protruding from the end fence elastically comes into contact with the trailing ends of an upper part of the bundle of sheets to press the upper part of the bundle of sheets. As a result, the upper part of the bundle of sheets can be brought into abutment with the front fence 36.

Consequently, the upper part of the bundle of sheets is positioned in the sheet conveyance direction by the front fence 36 and the pressing member 35. Hence, it is possible to keep the topmost sheet of the bundle of sheets from moving back when the blower 80 causes the leading end side of the topmost sheet to rise. As a result, it is possible to keep the topmost sheet P1 from moving further back than the second top sheet P2, and keep the leading end of the second top sheet P2 from being adsorbed to the adsorption belt 41 together with the topmost sheet P1. Consequently, the occurrence of double feed can be prevented.

Figure 12:
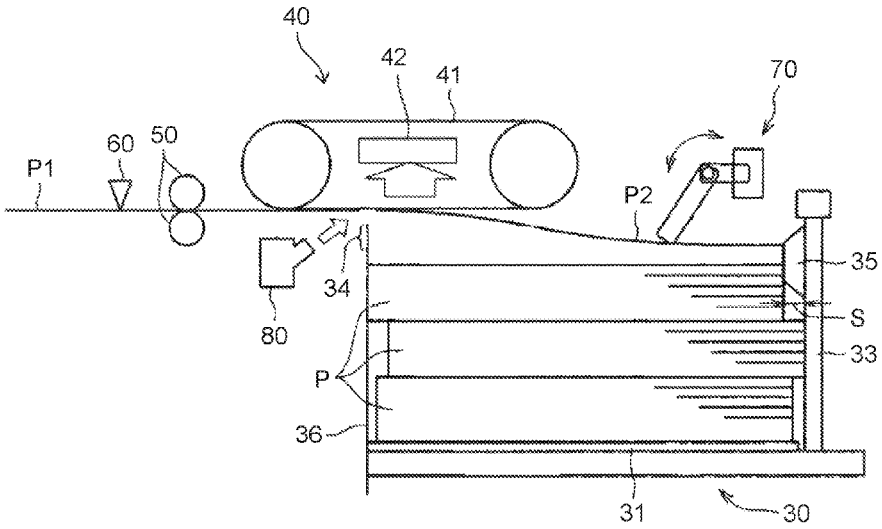
FIG. 12 is a diagram illustrating an example of a state where a bundle of sheets is set in a paper feeding tray without bringing leading ends of the bundle of sheets into abutment with a front fence.

FIG. 12 is a diagram illustrating an example of a state where a bundle of sheets is set in the paper feeding tray 30 without bringing the leading ends of the bundle of sheets into abutment with the front fence 36.

If the leading ends of the bundle of sheets are not brought into abutment with the front fence 36, the bundle of sheets is set in the paper feeding tray 30 in a state where the trailing ends of the bundle of sheets are not aligned as illustrated in FIG. 12. In this case, the bundle of sheets may be set in a state where the end fence 33 is in abutment with the trailing ends of part of the bundle of sheets. In this case, gaps are caused between the leading ends of the bundle of sheets and the front fence 36, and between the bundle of sheets and the end fence 33. However, in this case, the pressing member 35 provided to the end fence 33 presses the upper part of the bundle of sheets to move the upper part of the bundle of sheets toward the front fence. The leading ends of the upper part of the bundle of sheets are caused to abut the front fence 36. Consequently, the front fence 36 and the pressing member 35 position the upper part of the bundle of sheets in the sheet conveyance direction. Hence, it is possible to keep the topmost sheet from moving back when the blower 80 causes the leading end side of the topmost sheet of the bundle of sheets to rise.

Figure 13:
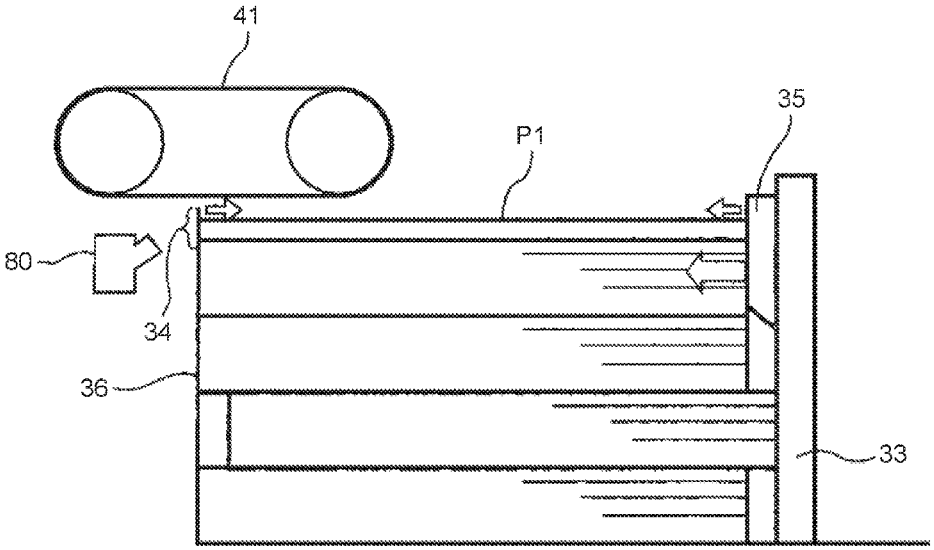
FIG. 13 is a diagram explaining an example of failure of a configuration having the same upward and downward pressing forces of the pressing member.

The sheets of the bundle of sheets are in close contact with each other. A large pressing force is required to some extent in order to cause the pressing member 35 to move the upper part of the bundle of sheets toward the front fence, and cause the leading ends of the upper part of the bundle of sheets to abut the front fence 36. However, if a pressing force that can move the upper part of the bundle of sheets toward the front fence is used as the pressing force of the pressing member 35, the following problem occurs: that is, as illustrated in FIG. 13, the leading end of the topmost sheet P1 hits strongly against the front fence 36 with the pressing force of the pressing member 35, and the sheet cannot rise smoothly. As a result, the sheet is not adsorbed to the adsorption belt by the sheet conveyance timing. Accordingly, paper feeding failure may occur. Especially, if the sheet is a sheet with high stiffness such as cardboard, the sheet resists warping so that the sheet may become rigid between the pressing member 35 and the front fence 36, and may not rise.

Figure 14:
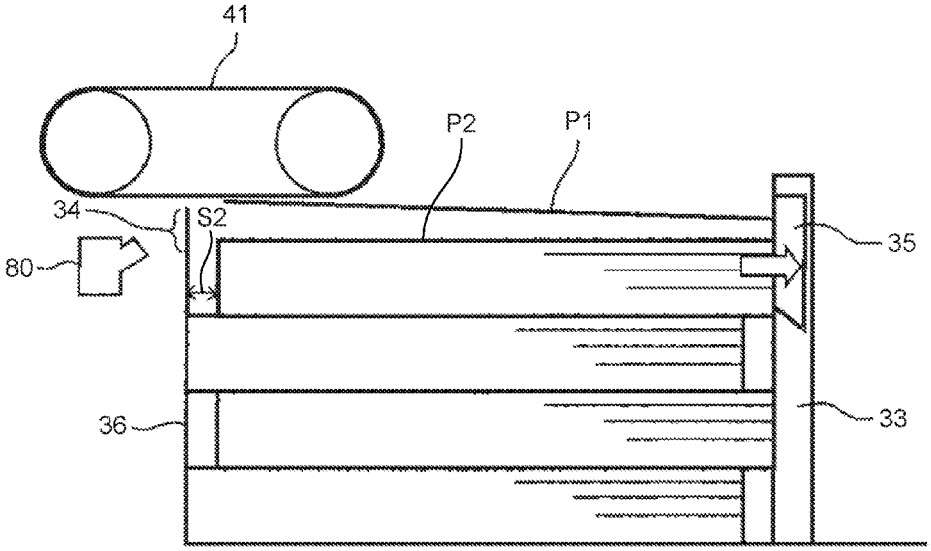
FIG. 14 is a diagram explaining another example of failure of the configuration having the same upward and downward pressing forces of the pressing member.

Hence, if the pressing force of the pressing member 35 is weakened, the pressing force of the pressing member cannot move the upper part of the bundle of sheets toward the front fence and the pressing member 35 enters into the end fence, as illustrated in FIG. 14. As a result, the leading ends of the upper part of the bundle of sheets are located at a position backward of a specified position where the front fence 36 abuts. As a result, the air of the blower may not be able to be blown excellently to the leading ends of sheets, and the topmost sheet may not be able to rise. Moreover, if the topmost sheet rises at a position backward of the specified position, the topmost sheet is adsorbed at a position backward of a specified position of the adsorption belt. As a result, a sheet conveyance delay occurs.

Hence, in the embodiment, an upper and a lower pressing force of the pressing member 35 are made different from each other. Specifically, a pressing force on the lower side of the pressing member 35 is made larger than a pressing force on the upper side. A specific description is given below using the drawings.

Figure 15:
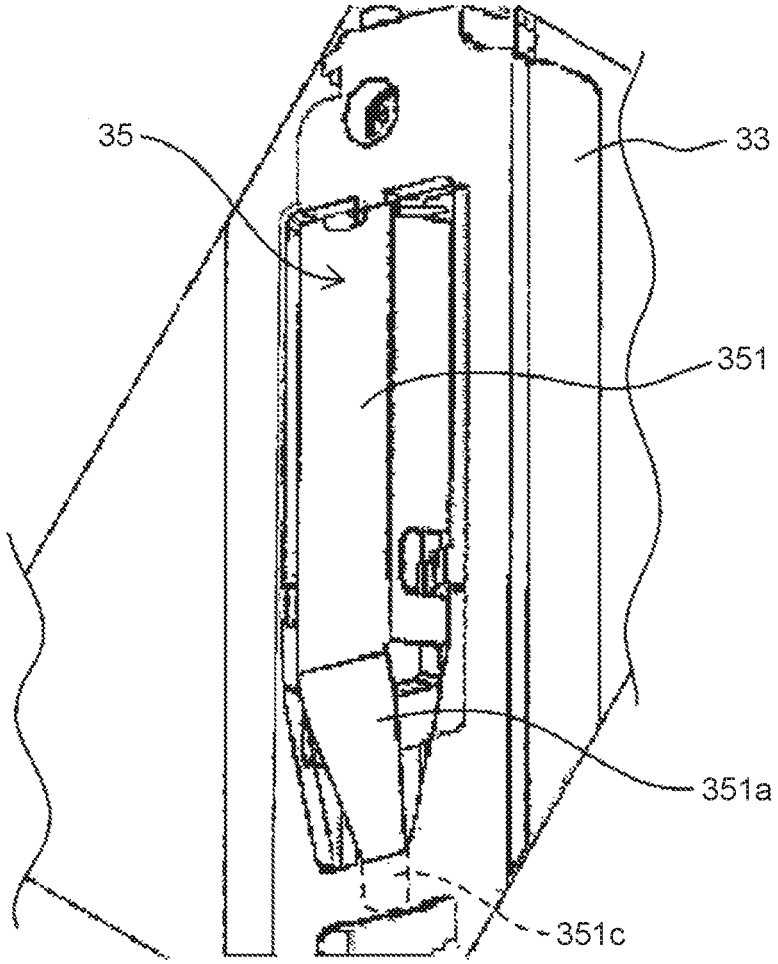
FIG. 15 is a perspective view of the vicinity of the pressing member of the embodiment.
Figure 16:
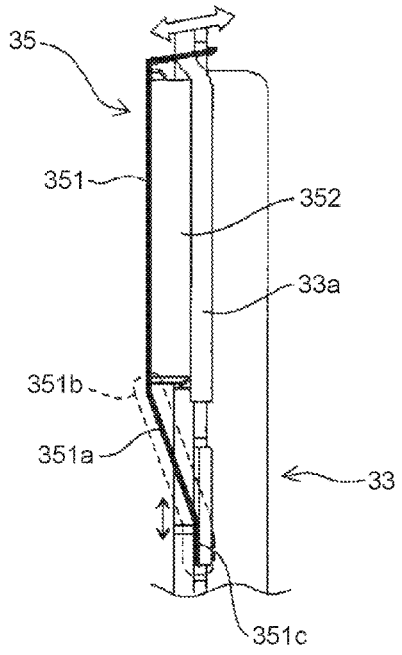
FIG. 16 is a cross-sectional view of the vicinity of the pressing member.

FIG. 15 is a perspective view of the vicinity of the pressing member 35 of the embodiment. FIG. 16 is a cross-sectional view of the vicinity of the pressing member 35.

The pressing member 35 includes a plate member 351 made of metal such as SUS, and an elastic member 352 such as sponge. An upper portion of the plate member 351 is adhered by double-sided tape to the elastic member 352. The elastic member 352 is adhered by the double-sided tape to a pressing member mounting portion 33*a* provided to the end fence 33.

A lower portion of the plate member 351 is bent toward a direction away from the trailing ends of the bundle of sheets to form a plate spring portion 351*b*. Moreover, with such bending, an inclined surface 351*a* that increases a distance to the trailing ends of the bundle of sheets toward the lower side is formed on the plate spring portion 351*b* of the lower portion. Moreover, a lower end 351*c* of the plate member 351 is embedded in the end fence 33. The elastic force of the plate spring portion 351*b* is larger than that of the elastic member 352.

Figure 17:
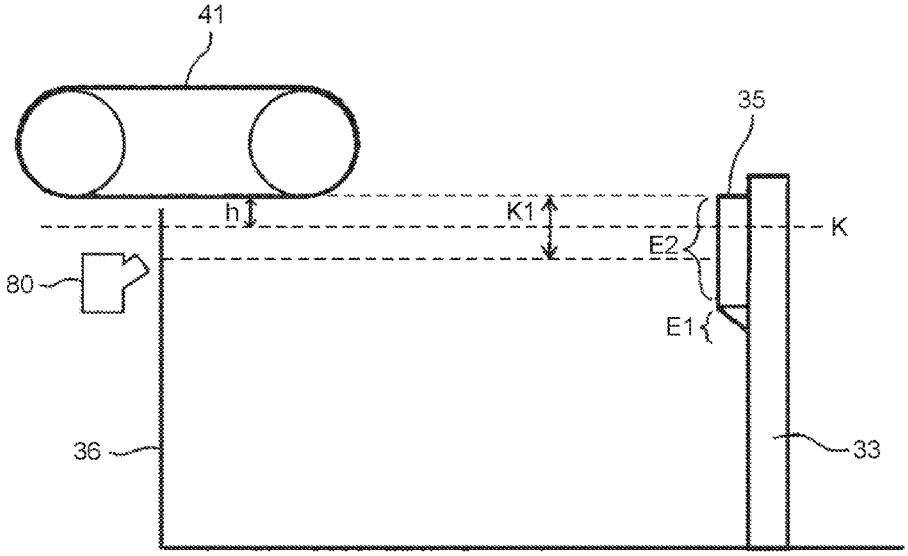
FIG. 17 is a diagram explaining the pressing force of the pressing member.

The pressing member 35 of the embodiment is configured as described above. Accordingly, as illustrated in FIG. 17, an upper pressing force E2 becomes the elastic force of the elastic member 352, and a lower pressing force E1 becomes the elastic force of the plate spring portion 351*b* larger than that of the elastic member 352. Consequently, the lower pressing force E1 of the pressing member 35 can be made larger than the upper pressing force E2. In the embodiment, a portion having a large pressing force is only the inclined surface 351*a* of the pressing member 35. A pressing force upward of the inclined surface 351*a* is the elastic force of the elastic member 352. Hence, as illustrated in FIG. 17, a pressing force of a separatable area K1 being an area where the blower 80 blows air, and a sheet is caused to rise and is separated from the bundle of sheets can be weakened. Consequently, the topmost sheet can be caused to rise excellently.

Figure 18A:
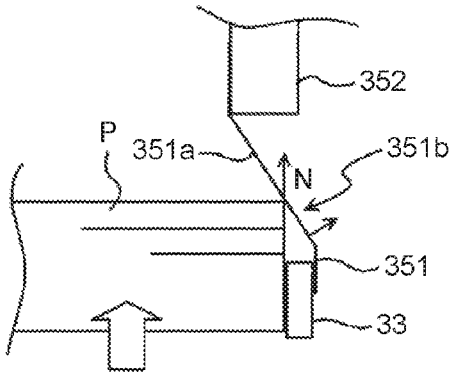
FIGS. 18A to 18C are diagrams explaining a state of the pressing member of when the bundle of sheets continues to be raised.
Figure 18B:
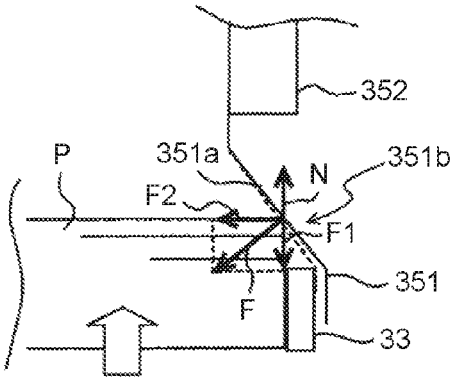
Figure 18C:
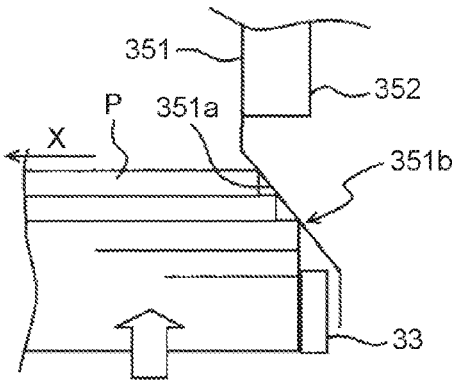

FIGS. 18A to 18C are diagrams explaining a state of the pressing member 35 of when the bundle of sheets continues to be raised.

If the bundle of sheets continues to be raised with a gap between the leading ends of the bundle of sheets P and the front fence 36 (see FIG. 4 and the like), the trailing ends of the bundle of sheets come into contact with the inclined surface 351*a* as illustrated in FIG. 18A.

In the embodiment, the lower end 351*c* of the plate member 351 is embedded in the end fence 33. Accordingly, the lower end 351*c* of the plate member 351 cannot come into contact with the bundle of sheets while the bundle of sheets is ascending. Consequently, the bundle of sheets is ensured to come into contact with the inclined surface 351*a*.

When the bundle of sheets comes into contact with the inclined surface 351*a*, the inclined surface 351*a* is pressed up by a force N lifting up the bundle of sheets. The inclined surface 351*a* then moves upward in such a manner as to rotate in a counterclockwise direction in the figure, pivoting on an upper end of the inclined surface 351*a*. The inclined surface 351*a* moves upward in this manner and accordingly it is possible to prevent the entire pressing member 35 from being lifted up due to the force N lifting up the bundle of sheets.

Moreover, the inclined surface 351*a* moves upward to add the elastic force of the plate spring portion 351*b* to the bundle of sheets. When the bundle of sheets is further raised from this state, the inclined surface 351*a* is further lifted up to increase the elastic force of the plate spring portion 351*b*. When a horizontal component F2 of an elastic force F of the plate spring portion 351*b* becomes equal to or more than the adhesion force (static friction) between sheets, sheets move in an arrow X direction as illustrated in FIG. 18C. The leading ends of the sheets abut the front fence 36.

The elastic force of the plate spring portion 351*b* is large. Accordingly, if the inclined surface 351*a* moves up a little with the force N lifting up the bundle of sheets, the horizontal component F2 of the elastic force F of the plate spring portion 351*b* can be made equal to or more than the adhesion force (static friction) between sheets. Consequently, the pressing member 35 can reliably move the sheets in the arrow X direction. The leading ends of the sheets can be brought into abutment with the front fence 36 to ensure the positioning of the upper part of the bundle of sheets at the specified position.

When the bundle of sheets ascends after the leading ends of the sheets abut the front fence 36, the pressing member 35 is pressed rightward in the figure by the sheets whose leading ends are in abutment with the front fence 36. The elastic member 352 is then depressed and accordingly, the entire pressing member 35 moves rightward in the figure. Accordingly, the sheets do not warp or bend. The trailing ends of the bundle of sheets move relatively along the inclined surface 351*a*. When the trailing ends of sheets come into contact with a surface of the plate member 351 parallel to the vertical direction, the sheets are pressed toward the front fence by the elastic force of the elastic member 352. Consequently, the upper part of the bundle of sheets is pressed by the weak elastic force of the elastic member 352.

Figure 19:
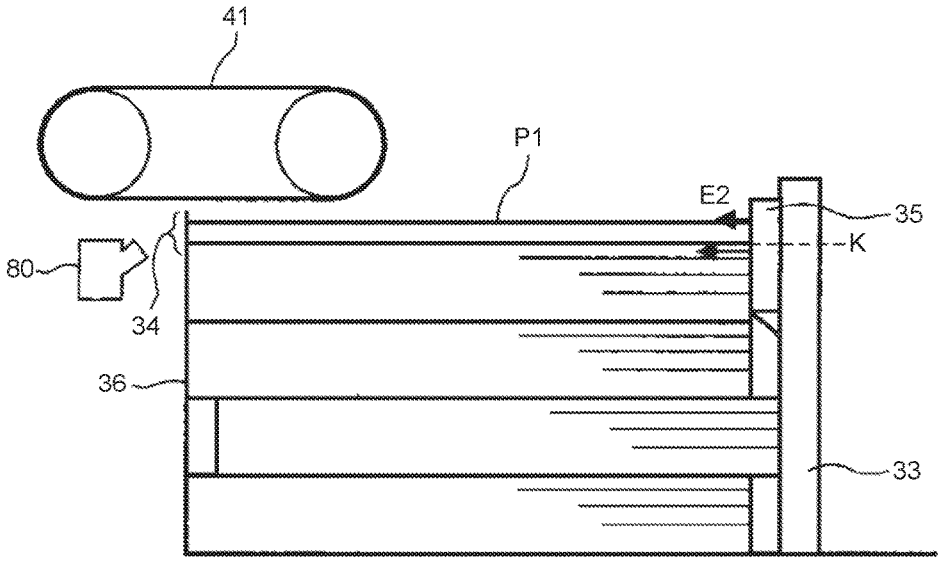
FIG. 19 is a diagram explaining the pressing force applied to an upper part of the bundle of sheets and a rising sheet of when the pressing member of the embodiment is used.

As illustrated in FIG. 19, in the embodiment, the upper part of the bundle of sheets is to be pressed with the weak pressing force E2 of the elastic member 352. Hence, the friction force between the leading ends of the upper sheets in the bundle of sheets and the front fence 36 can be weakened. The blower 80 and the suction device 42 can reliably cause the topmost sheet P1 of the bundle of sheets to rise. As a result, it is possible to cause the topmost sheet to be adsorbed to the adsorption belt 41 by the conveyance timing when the adsorption belt 41 is driven to rotate, and to prevent the occurrence of paper feeding failure.

Moreover, sheets in the bundle of sheets can be moved toward the front fence with the strong elastic force of the plate spring portion 351*b*. The leading ends of the sheets can be reliably brought into abutment with the front fence 36. Consequently, upper sheets in the bundle of sheets can be positioned at the specified position. Consequently, the air of the blower 80 can be blown to the leading end of the topmost sheet excellently so that the topmost sheet can be caused to rise excellently. Moreover, the topmost sheet of the bundle of sheets can be caused to rise while located at the specified position. Accordingly, the topmost sheet is adsorbed at the specified position of the adsorption belt 41. Consequently, it is possible to prevent the occurrence of sheet conveyance delay. Moreover, the leading ends of sheets abut the front fence 36 to ensure the contact of the trailing ends of the sheets with the pressing member. Therefore, the topmost sheet does not move back when rising. Consequently, it is possible to prevent the leading end of the rising second top sheet P2 from being located frontward of the topmost sheet, and prevent the occurrence of double feed.

When the leading ends of the bundle of sheets are in abutment with the front fence 36 and their trailing ends with the end fence 33, the elastic member 352 is depressed, and the pressing member 35 is accommodated in the end fence 33. The elastic member 352 is used to have a pressing force that allows sheets to rise smoothly also in this state.

Moreover, it is preferable to make a contact surface of the plate member 351 smooth, the contact surface coming into contact with sheets. The contact surface of the plate member 351 that comes into contact with sheets is made smooth so that the friction force between the pressing member 35 and the sheets can be reduced. Accordingly, it is possible to cause the sheets to rise smoothly and to slide the sheets smoothly along the inclined surface 351*a*.

Moreover, the above-mentioned failure such as double feed can be prevented as long as the topmost sheet of the bundle of sheets is positioned in the sheet conveyance direction by the pressing member 35 and the front fence 36. Therefore, the pressing member 35 is simply required to be provided only to the upper portion of the end fence 33. The pressing member 35 is provided only to the upper portion of the end fence 33 and accordingly there are also advantages that the apparatus can be made more compact and the costs of parts can be reduced as compared to a case where the pressing member 35 is provided to the end fence 33 over the up-and-down direction.

Figure 20:
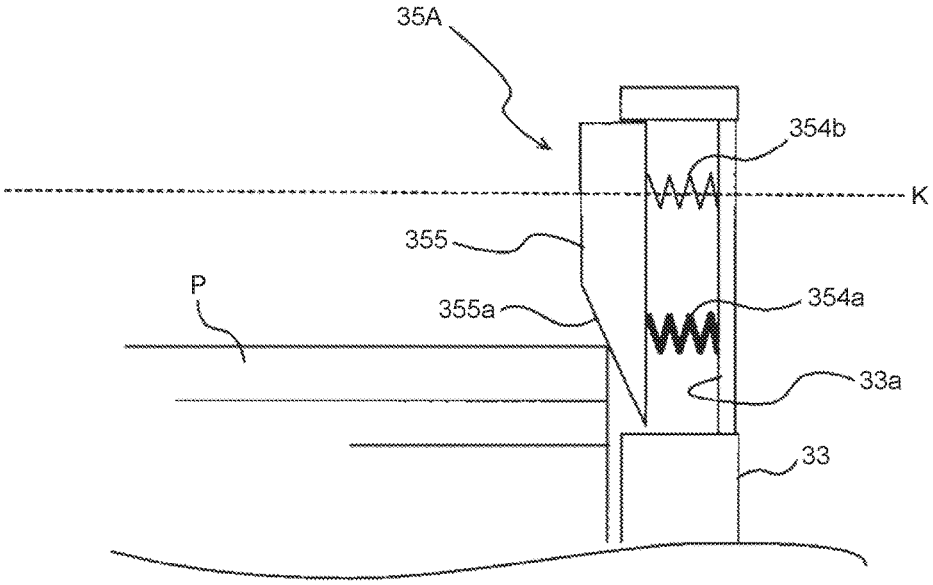
FIG. 20 is a schematic configuration diagram illustrating a pressing member of a first modification of the embodiment.

FIG. 20 is a schematic configuration diagram illustrating a pressing member 35A of a first modification of the embodiment.

The pressing member 35A of the first modification includes a contact member 355 that comes into contact with sheets, a first coil spring 354*a*, and a second coil spring

354*b*. The first coil spring 354*a* is in contact with a lower portion of the contact member 355 where an inclined surface 355*a* is formed. The second coil spring 354*b* is in contact with an upper portion of the contact member 355. The elastic force (biasing force) of the first coil spring 354*a* is larger than the elastic force (biasing force) of the second coil spring 354*b*. Consequently, also in the second modification, the pressing force of the lower portion of the pressing member can be made larger than the pressing force of the upper portion.

A bundle of sheets is raised. The trailing ends of the bundle of sheets come into contact with the inclined surface 355*a* of the contact member 355. The inclined surface 355*a* is pressed upward. The first coil spring 354*a* is then contracted. The contact member 355 inclines in such a manner as to rotate in a counterclockwise direction in the figure. When the first coil spring 354*a* continues to be contracted, the biasing force of the first coil spring 354*a* becomes equal to or more than the adhesion force (static friction) between sheets. In the first modification, the elastic force (biasing force) of the first coil spring 354*a* is large. Accordingly, the elastic force (biasing force) of the first coil spring 354*a* becomes equal to or more than the adhesion force (static friction) between sheets before the entire contact member 355 enters into the end fence 33. Therefore, also in the second modification, it is possible to press sheets with the pressing member 35 and bring the leading ends of the sheets into abutment with the front fence 36. Hence, also in the first modification, the front fence 36 and the pressing member 35 can position upper sheets in the bundle of sheets in the sheet conveyance direction.

Moreover, when the sheets move toward the front fence 36 and their leading ends abut the front fence 36, the pressing member 35A is pressed rightward in the figure by the sheets. The second coil spring 354*b* is then contracted, and the contact member 355 moves rightward in the figure. Consequently, the sheets do not warp or bend. Therefore, damage to the sheets can be prevented. When the topmost sheet of the bundle of sheets reaches an adsorption operation position K to stop the ascent of the bundle of sheets, the force pressing up the inclined surface 355*a* disappears. The second coil spring 354*b* then extends. The contact member 355 rotates in a clockwise direction in the figure to eliminate the inclination of the contact member 355.

Also in the first modification, the trailing ends of upper sheets in the bundle of sheets and the trailing ends of rising sheets come into contact with the upper portion of the pressing member 35A upon paper feeding. As a result, the upper sheets in the bundle of sheets and the rising sheets are pressed by the elastic force (biasing force) of the second coil spring 354*b*. The elastic force (biasing force) of the second coil spring 354*b* is weak. Therefore, the contact pressure between the leading ends of the upper sheets in the bundle of sheets and the front fence 36 is small. Hence, also in the first modification, it is possible to cause the topmost sheet P1 of the bundle of sheet to rise smoothly and to adsorb the topmost sheet P1 to the adsorption belt 41 by the paper feeding timing. Consequently, also in the first modification, conveyance failure can be prevented.

Figure 21:
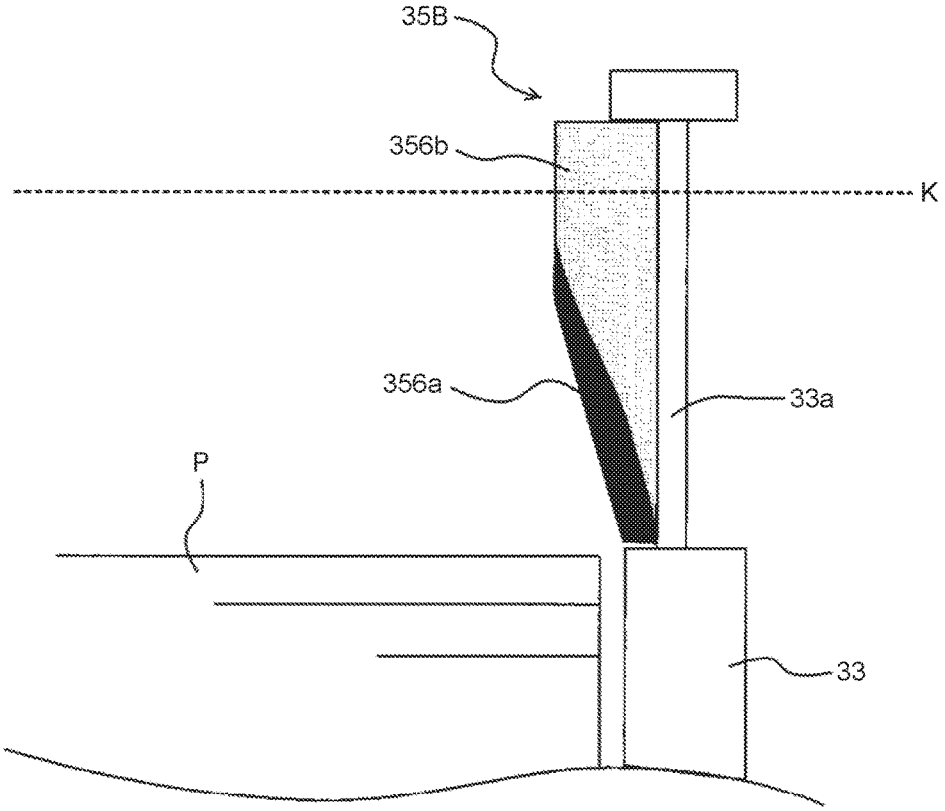
FIG. 21 is a schematic configuration diagram illustrating a pressing member of a second modification of the embodiment.

FIG. 21 is a schematic configuration diagram illustrating a pressing member 35B of a second modification of the embodiment.

The pressing member 35B of the second modification includes a first elastic member 356*a* and a second elastic member 356*b* having a smaller elastic force than that of the first elastic member 356*a*. The first elastic member 356*a* is provided to a lower portion of the second elastic member 356*b*. The thickness of the first elastic member 356*a* is adjusted in such a manner as that a pressing force on the lower portion side of the pressing member 35B is continuously reduced toward the upper side.

A large force is required to overcome the adhesion force (static friction) between sheets of a bundle of sheets and move sheets toward the front fence. However, it becomes dynamic friction after the sheets start moving toward the front. Therefore, the sheets can be moved without pressing them with a large force. Moreover, after the leading ends of the sheets abut the front fence 36, the sheets press the pressing member 35B. However, if the pressing force of the pressing member 35B is large at this point in time, the sheets may warp or bend.

Hence, in the second modification, the pressing force on the lower portion side of the pressing member 35B is configured to be continuously reduced toward the upper side. Consequently, when the bundle of sheets abut the inclined surface, a large pressing force is generated. Accordingly, the sheets can start moving excellently toward the front. The bundle of sheets starts ascending afterward. The sheets of the bundle of sheets move toward the front fence while being guided along the inclined surface of the pressing member 35B. The leading ends of the sheets abut the front fence. The sheets press an upper portion of the inclined surface of the pressing member 35B. The pressing force on the upper portion side of the inclined surface is reduced. Therefore, the pressing member 35B is depressed by the pressing force of the sheets. Consequently, the sheets do not warp or bend. Consequently, the bundle of sheets can be raised up to the adsorption operation position K without damaging the sheets in the bundle of sheets.

The upper portion of the pressing member 35B includes only the second elastic member 356*b* having a small elastic force. Hence, when the topmost sheet of the bundle of sheets is located at the adsorption operation position K, at least the topmost sheet of the bundle of sheets is pressed with the weak pressing force of the second elastic member 356*b*. Therefore, also in the second modification, the topmost sheet P1 of the bundle of sheets can be caused to rise smoothly as in the above description.

Moreover, in the above description, the embodiment where the present invention is applied to the paper feeding apparatus 200 is described. However, the present invention may be applied to the paper feeding unit 114 of the image forming apparatus 100 (FIG. 2).

Those described above are examples. The present invention have an effect specific to each of the following aspects.

(Aspect 1)

A paper feeding apparatus includes a sheet loading unit such as the bottom plate 31 on which a bundle of sheets is loaded, a separation unit such as the blower 80 that separates the topmost sheet P1 of the bundle of sheets loaded on the sheet loading unit, from the bundle of sheets, a conveyance unit such as the adsorption belt unit 40 that conveys the separated topmost sheet, the end fence 33 that is movable in a sheet conveyance direction, abuts trailing ends in the sheet conveyance direction of the bundle of sheets, and positions the bundle of sheets in the sheet conveyance direction, and a pressing unit being the pressing member 35 provided in such a manner as to protrude from the end fence 33 and configured to be able to press the trailing ends in the sheet conveyance direction of at least an upper part of the bundle of sheets. In the paper feeding apparatus, the pressing unit is configured to have different pressing forces at an upper and a lower portion thereof, and have the lower pressing force stronger than the upper pressing force.

According to aspect 1, when the bundle of sheets is raised while leading ends of the bundle of sheets are away from the front fence 36, the trailing ends of the upper part of the bundle of sheets come into contact with the lower portion of the pressing unit such as the pressing member 35. The pressing force of the lower portion of the pressing unit is stronger than that of the upper portion, and is a sufficient pressing force to move the upper part of the bundle of sheets toward the front fence. Consequently, when the trailing ends of the upper part of the bundle of sheets come into contact with the lower portion of the pressing unit, the upper part of the bundle of sheets can be moved toward the front fence with the pressing force of the pressing unit. As a result, it is possible to bring the leading ends of the upper part of the bundle of sheets into abutment with the front fence 36, and to position the trailing ends of the upper part of the bundle of sheets by the pressing unit.

In this manner, the bundle of sheets whose trailing ends of the upper part are positioned by the pressing unit ascends up to the adsorption operation position K where the separation unit such as the blower 80 causes the topmost sheet to rise. At this point in time, at least the trailing end of the topmost sheet of the bundle of sheets comes into contact with the upper portion of the pressing unit. The pressing force of the upper portion of the pressing unit is weaker than that of the lower portion. As a result, the pressing force on the topmost sheet can be reduced as compared to a case where the upper pressing force is the same as the lower pressing force. Consequently, the leading end of the topmost sheet can be prevented from hitting strongly against the front fence 36. As a result, at least the topmost sheet can be caused to rise smoothly. The topmost sheet can be adsorbed to an adsorption member such as the adsorption belt 41 by a sheet conveyance timing. The occurrence of paper feeding failure can be prevented.

Moreover, when the topmost sheet is caused to rise, the trailing end of the topmost sheet is in contact with the upper portion of the pressing unit. Therefore, the topmost sheet does not move back upon rising. Hence, it is possible to prevent the leading end of the second sheet from being located downstream in the sheet conveyance direction from the leading end of the topmost sheet, and the leading end of the second sheet from being adsorbed to the adsorption belt, together with the topmost sheet. As a result, the occurrence of double feed caused by such adsorption can be prevented.

(Aspect 2)

In the aspect 1, the pressing unit such as the pressing member 35 is provided with a plurality of elastic portions in the vertical direction. The elastic force of the elastic portion located on the lowest side is made stronger than those of the other elastic portions.

According to this, as described in the embodiment, the pressing force of the lower portion of the pressing unit such as the pressing member 35 can be made stronger than that of the upper portion.

(Aspect 3)

In the aspect 1 or the aspect 2, the pressing unit being the pressing member 35 is provided at the lower portion with the inclined surface 351*a* inclining upward toward the front fence 36.

According to this, sheets in the bundle of sheets can be smoothly moved toward the front fence with the pressing force of the pressing member 35.

(Aspect 4)

In the aspect 3, the pressing unit being the pressing member 35 includes the plate member 351 having a lower part being the plate spring portion 351*b* with the inclined surface 351*a*. An upper portion of the plate member 351 is attached to the end fence 33 via the elastic member 352. The elastic force of the elastic member 352 is smaller than that of the plate spring portion 351*b*.

According to this, as described in the embodiment, when the ascending bundle of sheets comes into contact with the inclined surface 351*a* to generate a force pressing up the inclined surface 351*a*, the inclined surface 351*a* of the plate spring portion moves upward. The force of the bundle of sheets pressing up the pressing member 35 can be absorbed. Consequently, it is possible to prevent the generation of a shear force in the elastic member 352 and damage to the elastic member 352. Moreover, the inclined surface 351*a* is pressed up to generate an elastic force by the plate spring portion 351*b*. Therefore, the sheets in the bundle of sheets can be pressed toward the front fence. Moreover, as the bundle of sheets ascends, the elastic force of the plate spring portion increases to increase the pressing force. The sheets in the bundle of sheets can be moved toward the front fence. Consequently, the leading ends of the sheets can be brought into abutment with the front fence. Moreover, the upper portion of the plate member is attached to the end fence via the elastic member. Accordingly, the upper portion of the pressing member is pressed by the elastic member having a smaller elastic force than that of the plate spring portion. Consequently, the contact pressure between the upper sheets in the bundle of sheet and rising sheets, which come into contact with the upper portion of the pressing member, and the front fence can be kept low. The sheets can be caused to rise smoothly, and adsorbed to the adsorption member such as the adsorption belt 41.

(Aspect 5)

In the aspect 4, at least a lower end of the plate member 351 is embedded in the end fence 33.

According to this, as described in the embodiment, the bundle of sheets can be reliably brought into contact with the inclined surface 351*a*.

(Aspect 6)

In the aspect 1 to the aspect 5, a pressing force of the pressing unit such as the pressing member 35 below at least a place corresponding to the separatable area where the topmost sheet of the bundle of sheets is separated by the separation unit is made stronger than those of the other places.

According to this, the sheets in the bundle of sheets are moved toward the front fence with the pressing force of the pressing member 35. Accordingly, the leading ends of the sheets can be brought into abutment with the front fence. Moreover, the pressing force is small in the separatable area. Accordingly, the sheets can be caused to rise smoothly.

(Aspect 7)

In the aspect 1 to the aspect 5, the separation unit has an air issuing unit such as the blower 80 that blows air to the leading end side in the sheet conveyance direction of at least the topmost sheet of the bundle of sheets to cause at least its leading end to rise from the bundle of sheets. The conveyance unit such as the adsorption belt unit 40 has an adsorption member such as the adsorption belt 41 that adsorbs the rising topmost sheet, and a suction unit such as the suction device 42 that suctions the topmost sheet to the adsorption member.

According to this, the topmost sheet can be separated from the bundle of sheets by being caused to rise with the air blown by the air issuing unit such as the blower 80. The separated topmost sheet can be conveyed, adsorbed to the adsorption member such as the adsorption belt 41.

(Aspect 8)

In the aspect 1, the pressing force of the pressing unit such as the pressing member 35 at least on the lower side than a paper feeding position is configured to be continuously reduced toward the upper side.

According to this, as described in the second modification, the leading ends of sheets that have moved, while ascending, toward the front fence with the pressing force of the pressing unit such as the pressing member 35 abut the front fence. However, the pressing force is continuously reduced so that the pressing force on the sheets upon the abutment of the leading ends of the sheets with the front fence is reduced as compared to the pressing force at the start of the movement of the sheets. Therefore, it is possible to prevent the sheets from warping and bending with the pressing force of the pressing unit after the leading ends of the sheets abut the front fence. The bundle of sheets can be excellently raised up to the paper feeding position.

(Aspect 9)

An image forming apparatus includes an image forming unit (in the embodiment, having the image formation unit 101, the transfer roller 106, the intermediate transfer belt 108, the secondary transfer roller 109, and the like) that forms an image on a sheet, and a paper feeding unit such as the paper feeding unit 114 that feeds sheets to the image forming unit. In the image forming apparatus, the paper feeding apparatus of any of the aspect 1 to the aspect 8 is used as the paper feeding unit.

According to this, it is possible to provide an image forming system that can prevent double-feed conveyance and paper feeding failure.

(Aspect 10)

An image forming system 1 includes an image forming apparatus 100 having at least an image forming unit that forms an image on a sheet, and a paper feeding apparatus 200 that feeds sheets to the image forming apparatus 100. In the image forming system 1, the paper feeding apparatus of any of the aspect 1 to the aspect 8 is used as the paper feeding apparatus.

With such a configuration, it is possible to provide the image forming system that can prevent double-feed conveyance and paper feeding failure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper feeding apparatus comprising:

a sheet loading unit on which a bundle of sheets is loadable;

a conveyance unit to convey a topmost sheet of the bundle of sheets from the sheet loading unit;

an end fence, movable in a sheet conveyance direction, to abut trailing ends in a sheet conveyance direction of the bundle of sheets; and a pressing unit, provided to protrude from the end fence, and configured to press the trailing ends in the sheet conveyance direction of at least an upper part of the bundle of sheets, wherein the pressing unit includes a contact member configured to come into contact with the sheets and a plurality of elastic portions placed between the contact member and the end fence, the plurality of elastic portions each including a different elastic force.

2. The paper feeding apparatus of claim 1, further comprising a separation unit to separate the topmost sheet of the bundle of sheets from the sheet loading unit.

3. The paper feeding apparatus of claim 2, wherein a pressing force of the pressing unit, including an elastic portion among the plurality of elastic portions, arranged below at least a place corresponding to a separable area where the topmost sheet of the bundle of sheets is separated by the separation unit, includes an elastic force relatively larger than elastic forces of other of the plurality of elastic portions.

4. An image forming apparatus comprising:

an image forming unit to form an image on a sheet; and the paper feeding apparatus of claim 3, to feed sheets to the image forming unit.

5. The paper feeding apparatus of claim 2, wherein the separation unit includes an air issuing unit, to blows air to a leading end side in the sheet conveyance direction of at least the topmost sheet of the bundle of sheets, and to cause at least a leading end to rise from the bundle of sheets, and wherein the conveyance unit includes an adsorption member to adsorb the rising leading end of the topmost sheet, and a suction unit to suction the topmost sheet to the adsorption member.

6. An image forming apparatus comprising:

an image forming unit to form an image on a sheet; and the paper feeding apparatus of claim 5, to feed sheets to the image forming unit.

7. An image forming apparatus comprising:

an image forming unit to form an image on a sheet; and the paper feeding apparatus of claim 2, to feed sheets to the image forming unit.

8. The paper feeding apparatus of claim 1, wherein a pressing force of the pressing unit, including an elastic portion among the plurality of elastic portions, arranged below at least a place corresponding to a separatable area where the topmost sheet of the bundle of sheets is separated by the separation unit, includes an elastic force relatively larger than elastic forces of other of the plurality of elastic portions.

9. An image forming apparatus comprising:

an image forming unit to form an image on a sheet; and the paper feeding apparatus of claim 8, to feed sheets to the image forming unit.

10. An image forming apparatus comprising:

an image forming unit to form an image on a sheet; and the paper feeding apparatus of claim 1, to feed sheets to the image forming unit.

11. The paper feeding apparatus of claim 1, wherein the contact member is a plate member.

12. The paper feeding apparatus of claim 11, wherein at least a relatively lower end of the contact member is embedded in the end fence.

13. An image forming apparatus comprising:

an image forming unit to form an image on a sheet; and the paper feeding apparatus of claim 12, to feed sheets to the image forming unit.

14. An image forming apparatus comprising:

an image forming unit to form an image on a sheet; and the paper feeding apparatus of claim 11, to feed sheets to the image forming unit.

15. The paper feeding apparatus of claim 1, wherein the contact member includes an inclined surface, inclined with respect to the end fence, and a surface paralleled to the end fence.

16. An image forming apparatus comprising:

an image forming unit to form an image on a sheet; and the paper feeding apparatus of claim 15, to feed sheets to the image forming unit.

* * * * *